US009177741B2

(12) United States Patent
Ghoreishi et al.

(10) Patent No.: US 9,177,741 B2
(45) Date of Patent: Nov. 3, 2015

(54) FAIL-OPEN MECHANISM FOR MOTORIZED SWITCH

(75) Inventors: Omid Ghoreishi, Edmonton (CA); Jeffrey Lim, Edmonton (CA); Obinna Ilochonwu, Saint-Cloud (FR); Adunola Ige, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 26 days.

(21) Appl. No.: 13/816,928

(22) PCT Filed: Aug. 13, 2010

(86) PCT No.: PCT/IB2010/053675

§ 371 (c)(1),
(2), (4) Date: Sep. 2, 2013

(87) PCT Pub. No.: WO2012/020285

PCT Pub. Date: Feb. 16, 2012

(65) Prior Publication Data

US 2014/0063674 A1 Mar. 6, 2014

(51) Int. Cl.

| | |
|---|---|
| ***H01H 3/00*** | (2006.01) |
| ***H01H 33/36*** | (2006.01) |
| ***H01H 3/28*** | (2006.01) |
| *H01H 3/26* | (2006.01) |

(52) U.S. Cl.

CPC ..... *H01H 33/36* (2013.01); *H01H 3/28* (2013.01); *H01H 2003/266* (2013.01)

(58) Field of Classification Search

CPC .... H01H 33/36; H01H 3/28; H01H 2003/266
See application file for complete search history.

(56) References Cited

U.S. PATENT DOCUMENTS

| | | | | |
|---|---|---|---|---|
| 2,280,898 | A | 4/1942 | Dyer et al. | |
| 3,064,163 | A | 11/1962 | Smith | |
| 3,211,958 | A | 10/1965 | Miller et al. | |
| 4,164,773 | A * | 8/1979 | DeLacy | 361/69 |
| 4,370,635 | A | 1/1983 | Carroll et al. | |
| 4,567,540 | A | 1/1986 | Ruta et al. | |
| 6,075,688 | A | 6/2000 | Willard et al. | |
| 6,842,322 | B2 | 1/2005 | Houbre | |
| 7,432,787 | B2 | 10/2008 | Muench et al. | |
| 2007/0138143 | A1 | 6/2007 | Muench et al. | |

OTHER PUBLICATIONS

International Search Report for PCT Application Serial No. PCT/IB2010/053675 dated May 6, 2011.
Office Action issued in JP2013-524486 on Dec. 25, 2013, 3 pages.
Examination Report issued in CA2808011 on May 26, 2014, 4 pages.

* cited by examiner

*Primary Examiner* — Zeev V Kitov
(74) *Attorney, Agent, or Firm* — Michael Stonebrook

(57) ABSTRACT

A fail-safe motorized switching system includes: (a) a motorized loadbreak switch system, the motorized loadbreak switch system adapted for opening and closing contacts between a high voltage power source and a load; (b) an energy storage device connected to the motorized loadbreak switch system; and (c) a controller connected to the energy storage device, the controller programmed with control logic to ensure that the motorized loadbreak switch system opens the contacts between the high voltage power source and the load once the power source is removed.

10 Claims, 3 Drawing Sheets

FAIL-OPEN MECHANISM FOR MOTORIZED SWITCH

BACKGROUND OF THE INVENTION

1. Field of the Invention

The present invention relates to motorized switches.

2. Description of Related Art

U.S. Pat. No. 2,280,898 discloses a capacitor tripping device for circuit breakers. U.S. Pat. No. 3,064,163 discloses a capacitor trip arrangement for an electric circuit breaker. U.S. Pat. No. 3,211,958 discloses a capacitor tripping device for circuit breakers. U.S. Pat. No. 6,842,322 discloses an electronic trip device comprising a capacitor for supply of a trip coil. U.S. Pat. No. 7,432,787 discloses a motorized loadbreak switch control system and method. Each of these patents is incorporated by reference in its entirety.

High voltage switching mechanisms, such as medium voltage switchgears, currently use expensive, large-footprint contactors. Although it would be advantageous for various reasons to use motorized switches instead of contactors, unlike contactors, however, motorized switches retain their open or dosed state upon loss of power. In contactors, a magnetic coil doses the contacts once it is energized, and a spring mechanism opens the contacts once power is removed (or is lost) to the coil, thus ensuring contactors always open upon power loss.

This limitation in motorized switches renders them unusable in applications where it is desired that the switching mechanism open when power is removed. An example where such a feature is required is in some distribution-class equipment such as medium voltage switchgears or variable frequency drives where the switching device (most commonly a contactor) is used to connect the power source to the load.

In these applications, if the power supply is removed, and the switching device remains closed, once power is restored, the bad will be connected directly to the power source without any operator control, which is highly undesirable.

Although there are many designs for motorized switches that are well known in the art, considerable shortcomings remain. What is needed is a motorized switch that will automatically switch to the "open" position upon loss of power.

BRIEF SUMMARY OF THE INVENTION

In one aspect, the present invention provides a fail-safe motorized switching system comprising: (a) a motorized loadbreak switch system, the motorized loadbreak switch system adapted for opening and closing contacts between a high voltage power source and a load; (b) an energy storage device connected to the motorized loadbreak switch system; and (c) a controller connected to the energy storage device and to the motorized loadbreak switch system, the controller programmed with control logic to ensure that the motorized loadbreak switch system opens the contacts between the high voltage power source and the load once the power source is removed.

In another aspect of the invention, a method for opening and closing contacts between a high voltage power source and a load comprises the steps of: providing a motorized loadbreak switch system between the high voltage power source and the load; connecting an energy storage device to the motorized loadbreak switch system; connecting a controller to the energy storage device; and programming the controller with control logic so that the motorized loadbreak switch system opens the contacts between the high voltage power source and the load once the power source is removed.

Additional objectives, features, and advantages will be apparent in the written description which follows.

BRIEF DESCRIPTION OF THE DRAWINGS

The novel features characteristic of the invention are set forth in the appended claims. However, the invention itself, as well as a preferred mode of use, and further objectives and advantages thereof, will best be understood by reference to the following detailed description when read in conjunction with the accompanying drawings in which the left-most significant digit(s) in the reference numerals denote(s) the first figure in which the respective reference numerals appear, wherein:

Figure 1:
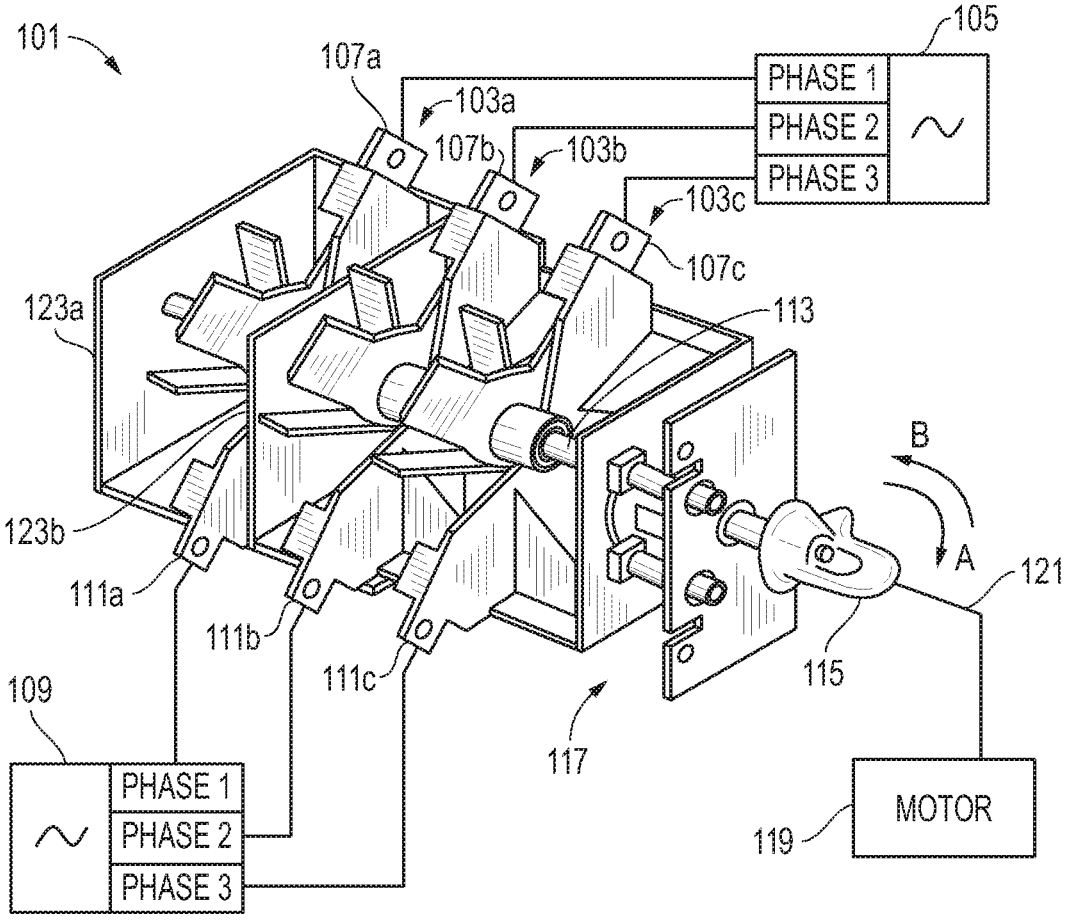
FIG. 1 (Prior Art)
FIG. 1 is a perspective view of a prior an motorized switch.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 depicts a prior art motorized switch 101 including three rotating switches 103*a*, 103*b*, 103*c*. Each of the rotating switches 103*a*, 103*b*, and 103*c* is adapted to switch a single phase of one or more power sources, and/or one or more loads.

For example, a high voltage power source 105 might connect its first phase to stationary contact 107*a*, its second phase to stationary contact 107*b*, and its third phase to stationary contact 107*c*. A high voltage power source 109 might connect its first, second, and third phases to stationary contacts 111*a*, 111*b* and 111*c*, respectively. Thus, the rotating switch 103*a* may select alternatively between the first phase of the power sources 105, 109 with the stationary contacts 107*a* and 111*a*, the rotating switch 103*b* may alternatively select between the second phase of the power sources 105, 109 with the stationary contacts 107*b* and 111*b*, and the rotating switch 103*c* may alternatively select between the third phase of the power sources 105, 109 with stationary contacts 107*c* and 111*c*.

The three-phase motorized switch 101 may be adapted to switch simultaneously each of the rotating switches 103*a*, 103*b*, 103*c*. More specifically, the rotating switches 103*a*, 103*b*, 103*c* are carried on a longitudinally extending shaft 113, and a handle 115 extends axially from the shaft 113. The handle 115 may be rotated, for example, in a first direction of rotation, indicated by the arrow A to charge a stored energy mechanism 117 that is also coupled to the shaft 113. The shaft 113 may connect each of rotating switches 103*a*, 103*b*, 103*c*. For example, the shaft 113 may extend through a rotational axis of each of the rotating switches 103*a*, 103*b*, 103*c*. When released, the stored energy mechanism 117 may cause the shaft 113 to rotate the rotating switches 103*a*, 103*b*, 103*c* simultaneously, at a speed independent of the speed of the operator. Alternatively, each of rotating switches 103*a*, 103*b*, 103*c* may include a separate actuator to actuate each of rotating switches 103*a*, 103*b*, 103*c* based on rotation of shaft 113. In either event, the three-phase power switch 101 may be used to switch simultaneously from the three phases of the first power source 105 to the three phases of the second power source 109. Alternatively, the three-phase power switch 101 may be adapted to switch two loads between a single three-phase power source.

Once the rotating switches 103*a*, 103*b*, 103*c* are completely rotated in the first direction of arrow A, the handle 115 may be rotated in a second direction, indicated by arrow B, opposite to the direction of arrow A, to reset the stored energy mechanism 117 as described above. A motor 119 is connected to the handle 115 with a mechanical linkage 121 so that as the motor output shaft rotates a given amount in the direction of arrows A and B, so does the handle 115. The linkage 121 may be manually disconnected from the handle 115 if needed or as desired, and the handle 115 may be manually rotated to operate the switch and/or reset the stored energy mechanism 117. In one embodiment the handle 115 may be rotated about three hundred sixty degrees about its axis between first and second operating conditions of the switch 101.

Baffles 123*a* and 123*b* may be provided to form an electrical barrier to suppress arcing between the separate phases, or between a phase and ground, that otherwise might cause damage to the three-phase power switch 101. By preventing an initial phase-to-phase or phase-to-ground arc from occurring, the baffles 123*a* and 123*b* may increase safety and reliability of the three-phase power switch 101.

Figure 2:
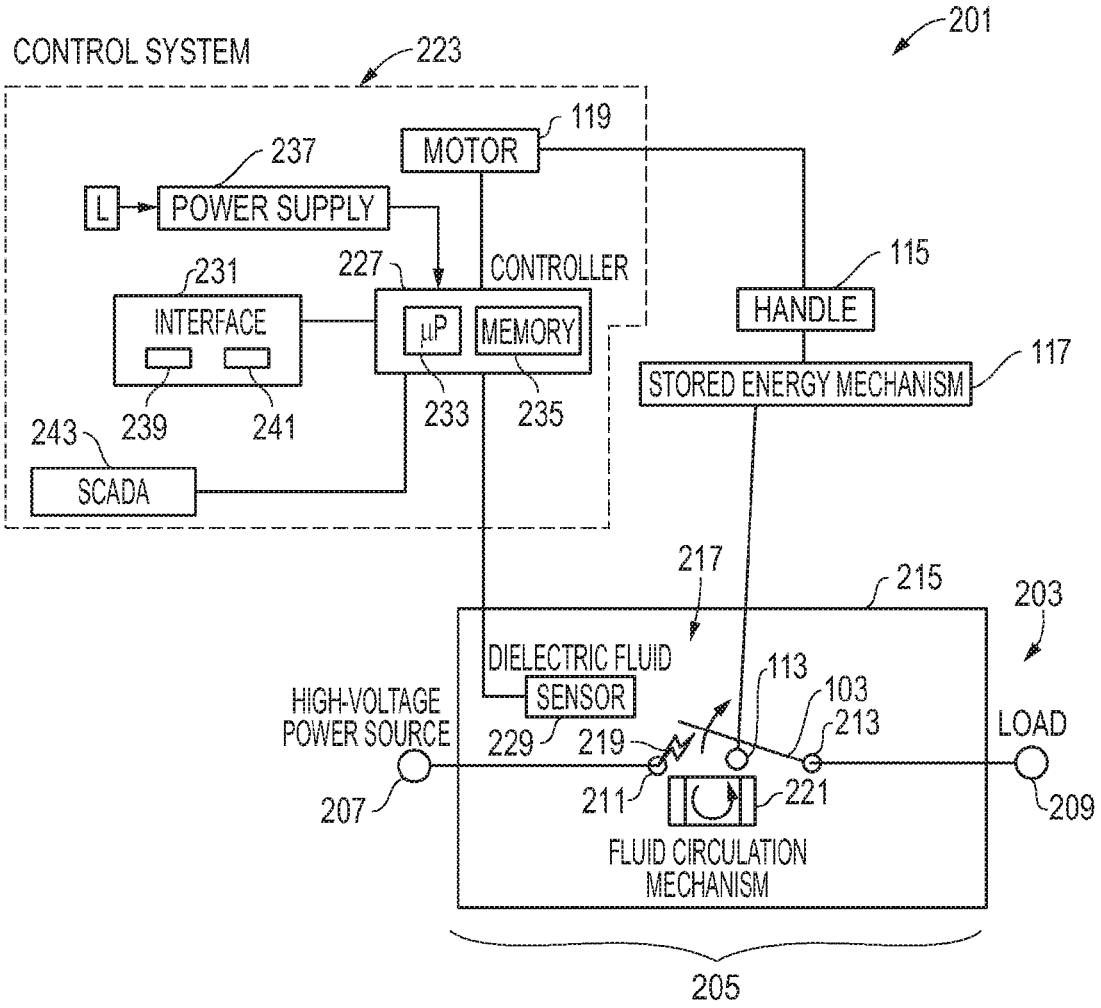
FIG. 2 (Prior Art)
FIG. 2 is a graphical representation of a prior art control mechanism for motorized switches.

FIG. 2 is a schematic diagram of an exemplary prior art high voltage motorized loadbreak switch system 201. The system includes a motorized loadbreak switch 203, described in detail below for illustrative purposes only to demonstrate its features.

In an exemplary embodiment, the prior art motorized loadbreak switch 203 defines an electrical path 205 between a high voltage power source 207 and a load 209. The electrical path 205 includes a rotating switch 103 having metallic switch contacts 211 and 213, and the rotating switch 103 is configured or adapted to open or close the electrical path 205 through the contacts 211 and 213. The high voltage motorized loadbreak switch 203 may be used within a casing 215 that holds elements of the high voltage motorized loadbreak switch 203 immersed, for example, in a dielectric fluid 217. In a known manner, the dielectric fluid 217 suppresses arcing 219 when the rotating switches 103*a*, 103*b*, 103*c* are opened to disconnect the bad 209 from the high voltage power source 207. In different embodiments, the dielectric fluid 217 may include, for example, base ingredients such as mineral oils or vegetable oils, synthetic fluids such as polyolesters, SF6 gas, silicone fluids, and mixtures of the same.

The motorized high voltage loadbreak switch 203 may be located, for example, in an underground distribution installation, and/or in a poly-phase industrial installation internal to a distribution or power transformer or switchgear. Normally, current is carried through the dosed contacts 211 and 213. When the motorized loadbreak switch 203 is opened, the current is carried through an electrical arc that is formed as the contacts 211, 213 open and separate. As those in the art will appreciate, the ability of the motorized loadbreak switch 203 to interrupt and extinguish the arc 219 that is formed by the opening of the contacts 211, 213 is a function of the length the arc 219 must travel as the contacts separate, the thermodynamic and dielectric properties of the dielectric fluid 217, the characteristics of the metal contacts 211 and 213, the rate at which the contacts 211 and 213 are separated, the rate that the dielectric fluid 217 recovers its dielectric capability as the arc 219 cools and passes through any normal current zero in an AC circuit, and the amount and type of gas, generated as the arc 219 passes through the dielectric fluid 217.

In view of this, the motorized loadbreak switch 203 may optionally include a fluid circulation mechanism 221 that circulates the dielectric fluid 217 around the rotating switch 103 to improve the strength of the dielectric fluid 217 by removing conductive impurities caused by arcing, such as carbonization elements and bubbles.

In an exemplary embodiment of the prior art, the rotating switch 103, and the fluid circulation mechanism 221 is carried on a rotating shaft 113 that may be actuated by a handle 115 extending exterior to the casing 215. The handle 115 may be turned, for example, to move the rotating switch 103 as desired, and markings may be provided on an exterior of the switch casing 215 to indicate the operating position of the rotating switch 103 when the handle 115 is in a given position. A known stored energy mechanism 117, including, for example, spring elements, may be provided to drive or index the rotating switch 103 from one position to another to open and close the electrical path 205. In a known manner, turning of the handle 115 charges the stored energy mechanism 117, and once the rotating switch 103 is released via movement of the handle 115, the stored energy mechanism 117 moves the rotating switch 103 at a proper speed to extend the arc and interact with the fluid to safely interrupt load current when the motorized loadbreak switch 203 is operated. The handle 115 may be operable, for example, to drive the rotating switch 103 in a clockwise direction or counterclockwise direction to actuate the motorized loadbreak switch 203.

In one embodiment of the prior art, the motorized loadbreak switch 203 is, for example, a four position switch, explained further below, wherein the movement of the shaft 113 causes contact blades to shift from one position to another, and the blade movement reconfigures the connection of or isolation of power sources and/or loads by breaking or making electrical connections between contacts rotating with the shaft 113 and stationary contacts fixed to a switch block. When the handle 115 is rotated to charge the stored energy mechanism 117, a cam system releases a locking bar so the shaft 113 is free to rotate. The shaft 113 is then driven by the energy stored in the springs, and the shaft 113 may continue to be rotated in the same direction beyond three hundred sixty degrees of rotation by actuating the handle 115. To operate properly, the rotating switch 103, in response to actuation of the handle 115, must complete a switching operation and revert to an at-rest position after completion of the switching operation.

In another embodiment the prior art motorized loadbreak switch 203 may be a two position on/off switch wherein the stored energy mechanism 117 is an over-toggled-spring that controls motion of the shaft 113 over a range less than three hundred sixty degrees. In this case, the movement of the shaft 113 must be reversed to operate the switch between the on and off positions.

In either a two position or four position switch, to operate the switch correctly, the handle 115 typically must be rotated a distance beyond the release point. The movable switch contacts of the rotating switch 103 are engaged to stationary contacts mounted to switch insulating structures with sufficient force between the contacts to ensure acceptable current carrying capability. Consequently, significant input torque is required to move the handle 115 to the point of release, break the connection between the contacts, and enable the stored energy mechanism 117 to complete the remainder of the switching mechanism movement. Properly controlling input torque to the handle 115 is difficult, and operators tend to exert excessive force on the handle 115 to release the switching mechanism. Even if actuation of the handle 115 is motorized, a startup torque of the motor is not easy to control, and typically will result in some loading of the stored energy mechanism 117. Additionally, the amount of torque necessary to release the switching mechanism may vary at different times and locations due to temperature fluctuation, current fluctuation, and other factors. Such loading, to whatever degree, of the stored energy mechanism 117 is undesirable and impairs further use of the motorized loadbreak switch 203.

Therefore, to ensure proper operation of the motorized loadbreak switch 203, the loading of the stored energy mechanism 117 due to actuation of the handle 115 must be removed from the stored energy mechanism 117, allowing the mechanism 117 to return to a rest or neutral position before the motorized loadbreak switch 203 is again operated. When operated manually by a line technician with specially designed tools, the mechanism 117 is self-resetting. If used with a motorized driving system, the self-resetting mechanism 117 can easily be defeated by any residual force left on the mechanism by the motor, thereby frustrating the capability of the motorized loadbreak switch 203 to be controlled remotely.

To alleviate these and other concerns, a control system 223 is provided. As shown in FIG. 2, the control system 223 may include a motor 119, a controller 227 communicating with the motor 119, one or more sensors or transducers 229 communicating with the controller 227, and a control interface 231.

The motor 119 is responsive to the controller 227 and is mechanically linked to the switch handle 115 to turn the handle 115 to a position wherein the rotating switch 103 is released and the stored energy mechanism 117 may complete the movement of the rotating switch 103 to, for example, a fully opened or fully closed position. As one example, the motor 119 may be a known electric motor, and in a further embodiment the motor 119 may be a stepper motor that rotates an output shaft incrementally to predetermined positions, and the position of the motor output shaft may be precisely positionable. A variety of AC and DC electric motors may be used to power the handle 115 to a release position wherein the stored energy mechanism 117 may complete the movement of the rotating switch 103.

The controller 227 may be, for example, a microcomputer or other processor 233 coupled to the motor 119 and the control interface 231. A memory 235 is also coupled to the controller 227 and stores instructions, calibration constants, and other information as required to satisfactorily operate the motorized loadbreak switch 203 as explained below. The memory 235 may be, for example, a random access memory (RAM). In alternative embodiments, other forms of memory could be used in conjunction with RAM memory, including, but not limited to, flash memory (FLASH), programmable read only memory (PROM), and electronically erasable programmable read only memory (EEPROM).

Power to the control system 223 is supplied to the controller 227 by a power supply 237 configured or adapted to be coupled to a power line L. Analog to digital and digital to analog converters may be coupled to the controller 227 as needed to implement controller inputs from the sensor 229 and to implement executable instructions to generate controller outputs to the motor 119

The control interface 231 may be provided, either at the site of the motorized loadbreak switch 203 or in a remote location, and the interface 231 may include one or more control selectors 239 such as buttons, knobs, keypads, touchpads, and equivalents thereof that may be used by an operator to energize the motor 119 and open or close the motorized loadbreak switch 203. The interface may also include one or more indicators 241, such as light emitting diodes (LEDs), lamps, a liquid crystal display (LCD), and equivalents thereof that may convey operating and status information to the operator. The control interface 231 is coupled to the controller 227 to display appropriate messages and/or indicators to the operator of the motorized loadbreak switch 203 and confirm, for example, user inputs and operating conditions of the motorized loadbreak switch 203.

In response to user manipulation of the control interface 231, the controller 227 monitors operational factors of the motorized loadbreak switch 203 with one or more sensors or transducers 229, and the controller 227, through the motor 119, actuates the switch handle 115. The controller 227 may further be coupled to a remote operating control system 243, such as known Supervisory Control and Data Acquisition (SCADA) system. Using the remote operating control system 243, the motorized loadbreak switch 203 may be remotely monitored and controlled.

Figure 3:
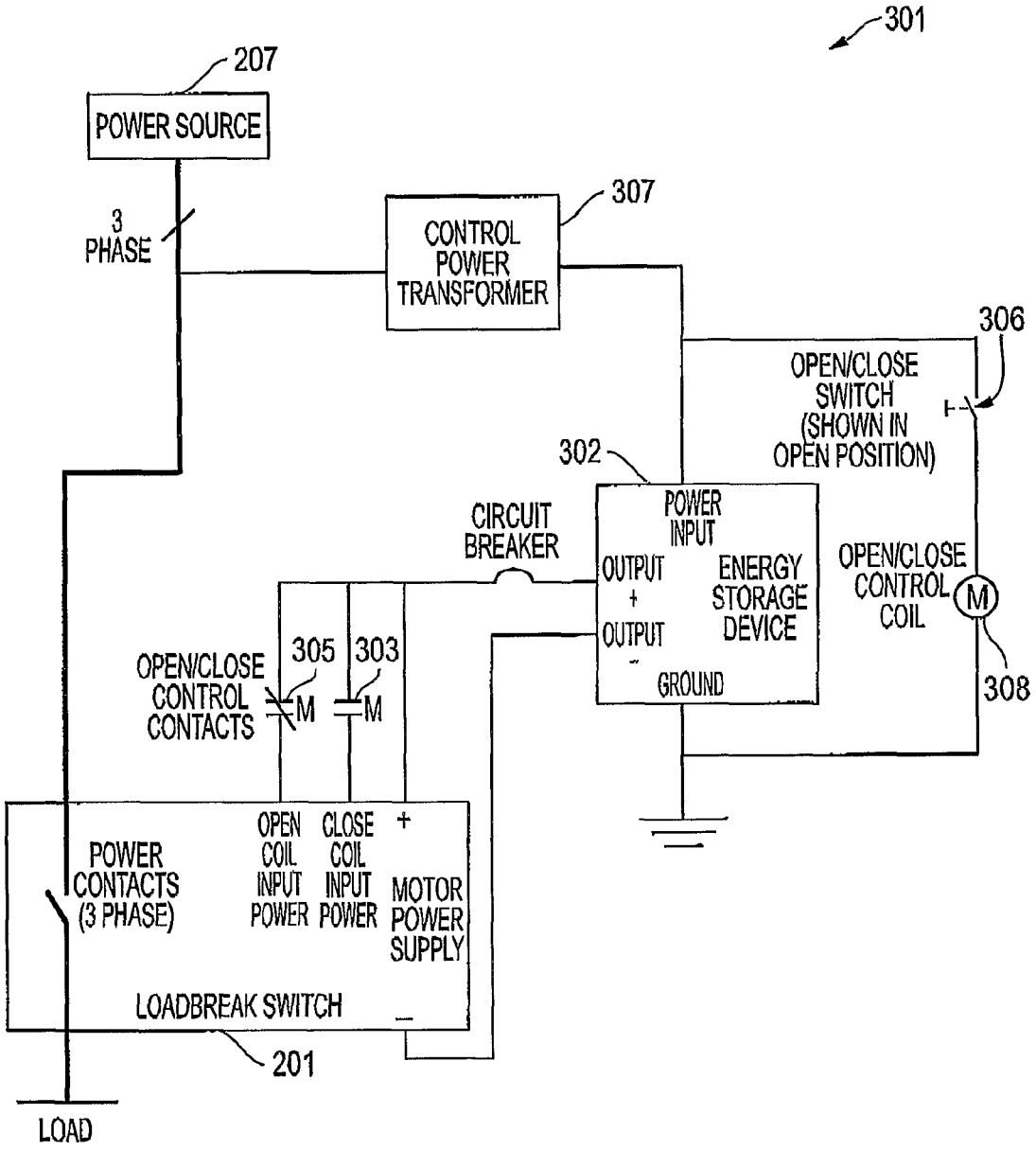
FIG. 3 is a graphical representation of an illustrative embodiment of a fail-open system for a motorized switch of the present invention.

Referring now to FIG. 3, an energy storage device 302, such as an uninterruptable power supply or battery, is continually charged by a control power transformer 307 fed by the power source 207. To open or close the high voltage loadbreak switch system 201, using control logic, power from the energy storage device 302 is directed to either an "open coil" control contact 303 or a "close coil" control contact 305 associated with the loadbreak switch system 201. The energy storage device 302 also provides power to the motor 119 inside the loadbreak switch system 201.

During normal operation (i.e. while power source 207 is supplying power), the user can control the opening and closing of the loadbreak switch 201 by using the open/close switch 306. If the open/close switch 306 is moved to the close position, the open/close control coil 308 becomes energized, and the normally closed control contact 305 and the normally open control contact 303 change state and are opened and closed, respectively. The output of the energy storage device 302 is thus directed to the close coil input power terminal of the loadbreak switch 201, thus closing the loadbreak switch 201. If the user opens the open/close switch 306, the open/close control coil 308 becomes deenergized, and the normally closed control contact 305 and the normally open control contact 303 change their state to their normal state and are closed and opened, respectively, and the output of the energy storage device 302 is thus directed to the open coil input power terminal of the loadbreak switch 201, thus opening loadbreak switch 201.

In case of loss of power supply from power source 207 and, subsequently, control power transformer 307, the open/close control coil 308 becomes deenergized regardless of the position of the open/close switch 306 ensuring the normally closed control contact 305 and the normally open control contact 303 are back to their normal state, and thus directing power from the energy storage device 302 to the open coil input power terminal of loadbreak switch 201.

In other words, the control logic is designed such that upon loss of power, the output of energy storage device 302 is directed to the open coil input power terminal of loadbreak switch 201, and energy storage device 302 is designed such that it stores sufficient energy to energize the open coil of loadbreak switch 201 in the absence of power source 207.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope of the invention. Accordingly, the protection sought herein is as set forth in the claims below. Although the present invention is shown in a limited number of forms, it is not limited to just these forms, but is amenable to various changes and modifications.

What is claimed is:

1. A fail-safe motorized switching system, comprising:

a motorized loadbreak switch system, the motorized loadbreak switch system adapted for opening and closing a contact between a high voltage power source and a load;

an energy storage device connected to the motorized loadbreak switch system; and control circuitry comprising a switch and a coil, the switch having an open position and a closed position that causes a supply of energy from the energy storage device to the motorized loadbreak switch system for closing the contact, the coil having an energized state corresponding to the closed position of the switch and a de-energized state corresponding to either the open position of the switch or a loss of power supply from the power source, wherein when the coil is in a de-energized state the motorized loadbreak switch system opens the contact between the power source and the load.

2. The system of claim 1, wherein the motorized loadbreak switch system further comprises a motorized loadbreak switch and a control system for controlling the operation of the motorized loadbreak switch.

3. The system of claim 2, wherein the control system further comprises a control interface comprising at least one input selector and at least one indicator, the control interface configured to: accept, via the at least one input selector, operator input for controlling the motorized loadbreak switch, and display information regarding the motorized loadbreak switch via the at least one indicator.

4. The system of claim 3, wherein the motorized loadbreak switch further comprises a motorized switch, the motorized switch comprising:

a plurality of rotating switches on a longitudinally extending shaft;

a handle extending axially from the shaft;

a motor coupled to the shaft, and a stored energy mechanism coupled to the shaft.

5. The system of claim 4, wherein the handle is adapted to be manually rotated to operate the motorized switch and to reset the stored energy mechanism.

6. A method for opening and closing contacts between a high voltage power source and a load, comprising the steps of:

providing a motorized loadbreak switch system between the high voltage power source and the load;

connecting an energy storage device to the motorized loadbreak switch system; and connecting circuitry to the motorized loadbreak switch system and to the energy storage device wherein the circuitry comprises a switch and a coil, the switch having an open position and a closed position that causes a supply of energy from the energy storage device to the motorized loadbreak switch system for closing the contact between the high voltage power source and the load, the coil having an energized state corresponding to the closed position of the switch and a de-energized state corresponding to either an absence of power from the high voltage power source or the open position of the switch, wherein when the coil is in a de-energized state the motorized loadbreak switch system opens the contact.

7. The method of claim 6, wherein the motorized loadbreak switch system comprises a motorized loadbreak switch and a control system for controlling the operation of the motorized loadbreak switch.

8. The method of claim 7, wherein the control system further comprises a control interface comprising at least one input selector and at least one indicator, the control interface configured to: accept, via the at least one input selector, operator input for controlling the motorized loadbreak switch, and display information regarding the motorized loadbreak switch via the at least one indicator.

9. The method of claim 8, wherein the motorized loadbreak switch further comprises a motorized switch, the motorized switch comprising:

a plurality of rotating switches on a longitudinally extending shaft;

a handle extending axially from the shaft;

a motor coupled to the shaft, and a stored energy mechanism coupled to the shaft.

10. The method of claim 9, wherein the handle is adapted to be manually rotated to operate the motorized switch and to reset the stored energy mechanism.

* * * * *